United States Patent [19]

Kanto et al.

[11] Patent Number: 5,036,041

[45] Date of Patent: Jul. 30, 1991

[54] HEAT TRANSFER SHEET

[75] Inventors: Jumpei J. K. Kanto; Hitoshi H. S. Saito; Hiroshi H. E. Eguchi; Masayuki M. N. Nakamura, all of Tokyo, Japan

[73] Assignee: Dai Nippon Insatsu Kabushiki Kaisha, Tokyo, Japan

[21] Appl. No.: 480,719

[22] Filed: Feb. 15, 1990

[30] Foreign Application Priority Data

Feb. 15, 1989 [JP] Japan ..... 1-33753
Aug. 4, 1989 [JP] Japan ..... 1-202459

[51] Int. Cl.[5] ..... B41M 5/35; B41M 5/26

[52] U.S. Cl. ..... 503/227; 8/471; 428/195; 428/690; 428/913; 428/914

[58] Field of Search ..... 8/471; 428/195, 913, 428/914; 503/227

[56] References Cited

FOREIGN PATENT DOCUMENTS 0179295 9/1985 Japan ..... 503/227

*Primary Examiner*—Bruce H. Hess
*Attorney, Agent, or Firm*—Parkhurst, Wendel & Rossi

[57] ABSTRACT

A heat transfer sheet including at least a dye layer of cyan color formed on the surface of a substrate sheet, the dye contained in said dye layer including a mixture of at least two kinds of cyan dyes, one of the cyan dyes which has a maximum absorption on the shortest wavelength side being a cyan dye having absorption characteristics with a narrow absorption width.

7 Claims, No Drawings

HEAT TRANSFER SHEET

BACKGROUND OF THE INVENTION

This invention relates to a heat transfer sheet, more particularly, to a heat transfer sheet capable of forming an image having excellent color reproducibility as well as sharpness of the printed image.

Various heat transfer methods have been known in the art, and among them, there has been proposed a method in which a sublimable dye is used as the recording material. The dye is carried on a substrate sheet such as a polyester film to form a heat transfer sheet. By using the transfer sheet, various full colors are formed on an image-receiving sheet having a dye receptive layer with a sublimable dye such as paper or plastic film.

In the above full-color heat transfer method, in most cases, by use of heat transfer sheets of 3 or 4 colors of yellow, magenta, cyan (and black) or a heat transfer sheet having these 3 or 4 colors formed plane successively on a continuous substrate sheet, a thermal head is actuated by the electrical signals formed by resolving the original into 3 or 4 colors to effect printing with matching of the 3 or 4 colors on one heat transfer image-receiving sheet, thereby reproducing the full-color image on the image-receiving sheet.

The image thus formed is very sharp, since the colorant used is a dye having excellent transparency, whereby the obtained image is excellent in reproducibility and gradation of the intermediate color, similar to the image according to the offset printing or gravure printing of the prior art, and further can form an image of high quality comparable with full-color photographic image.

In forming the color image comprising the 3 primary colors, all of the respective colors should have high spectral characteristics. In particular, in the case of a cyan dye, it should ideally have an absorption curve of so-called block type, having no absorption at around 540 nm or shorter and absorbing the wavelengths longer than that.

However, existing cyan dyes exhibit the so called hanging bell type absorption curve, with its skirt on the shorter wavelength side extending to the range of 540 nm or shorter, whereby there is the problem that the lightness and the chromaticity of the cyan image color formed becomes lower due to absorption of 540 nm or lower.

Such problem becomes more marked as the image density is made higher. Further, since the components of 540 nm or lower fall within the green light region, there is the problem that the intermediate color of green, etc. formed by primary color mixing with yellow dye, etc. during image formation becomes indistinct.

Also, generally speaking, dyes which are excellent in sharpness are inferior in light resistance and bleeding resistance. On the contrary, dyes which are excellent in light resistance and bleeding resistance have a tendency to be inferior in sharpness. Thus, both sharpness and other properties such as light resistance, etc. cannot be obtained easily in most cases. On the other hand, the image-receiving sheet comprises a resin layer having dye dyability formed on the surface of a film or a sheet in most cases. These resin layers, however, are generally tinted with yellow and therefore there is involved the problem that sharpness of the transferred dye is degraded.

As the method for solving the above drawbacks, it may be conceivable to add a fluorescent brightening agent in the dye receptive layer so as to extinguish the yellow tint of the receptive layer and also enhance sharpness of the transferred dye.

However, since fluorescent brightening agents are compounds which absorb UV-ray and emit blue to violet light, and inevitably tend to extinguish yellow color thereby causing a problem that color forming characteristics and sharpness of yellow colors are degraded, whereby there is the problem that color reproducibility and color forming characteristics of yellow colors of full-color originals are lowered.

Accordingly, an object of the present invention is to provide a heat transfer sheet capable of forming a transferred image having excellent sharpness and color reproducibility in a heat transfer recording system by use of a sublimable dye.

SUMMARY OF THE INVENTION

The above objects can be accomplished by the present invention as described below.

The present invention is a heat transfer sheet comprising at least a dye layer of cyan color formed on the surface of a substrate sheet, the dye contained in said dye layer comprising a mixture of at least two kinds of cyan dyes, and one of the cyan dyes which has a maximum absorption on the shortest wavelength side being a cyan dye having absorption characteristics with a narrow absorption width.

By forming the dye layer of cyan color of the heat transfer sheet from a mixture of two or more kinds of cyan dyes, and using the cyan dye having the maximum absorption on the shortest wavelength side with narrow absorption width, it becomes possible to form a cyan color with little absorption components at 540 nm or lower even at high density, whereby a heat transfer sheet capable of forming images having excellent color reproducibility of the cyan color, and also the intermediate color synthesized with said cyan color and other colors being excellent.

Further, in the present invention, by including a fluorescent brightening agent in the dye layer of magenta color and/or cyan color of the heat transfer sheet or forming a layer containing the above fluorescent brightening agent on the surface of the dye layer, and transferring these fluorescent brightening agents to the image forming region simultaneously with transfer of the dye, it becomes unnecessary to use a fluorescent brightening agent in the dye receptive layer, whereby a color image having excellent sharpness and color reproducibility can be obtained without lowering the color forming characteristic or sharpness of yellow color.

DETAILED DESCRIPTION OF THE INVENTION

The present invention is described below in more detail by referring to preferable embodiments.

As the substrate sheet of the heat transfer sheet of the present invention, any of those known in the art having heat resistance and strength to some extent may be available. For example, there may be included papers, various converted papers, polyester films, polystyrene films, polypropylene films, polysulfone films, Aramide films, polycarbonate films, polyvinyl alcohol films, Cellophanes, etc., particularly preferably polyester films, having a thickness of about 0.5 to 50 μm, preferably 3 to 10 μm.

The substrate sheet as mentioned above should be preferably applied on its surface with the primer treatment or the corona discharging treatment, when the adhesive force to the dye layer formed thereon is poor.

The sublimable (heat-migratable) dye layer to be formed on the substrate sheet as mentioned above is a layer having a cyan dye carried with any desired binder.

The cyan dye to be used in the present invention may be a dye known for use in the sublimation type heat transfer, and any of known dyes may be available. In the present invention, two or more kinds of these cyan dyes are used as a mixture, and for at least one of them is used a dye (I), having a maximum absorption on the relatively longer wavelength side, namely, 660 nm or higher, when color formation was effected on the image-receiving sheet. Such dye has little absorption of 540 mn or shorter which becomes the green component, because its maximum absorption exists on the longer wavelength side.

Preferable specific examples of such cyan dye (I) may include the dyes of the following structural formulae.

(I)-1

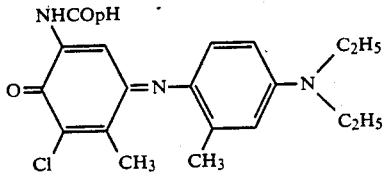

(I)-2

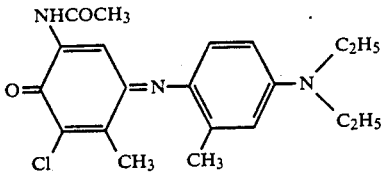

(I)-3

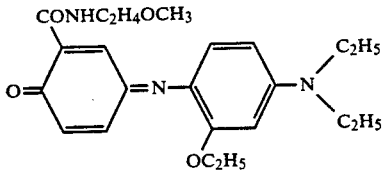

(I)-4

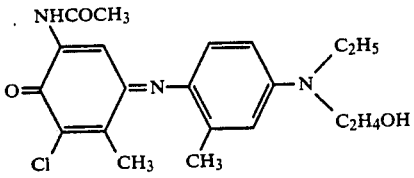

(I)-5

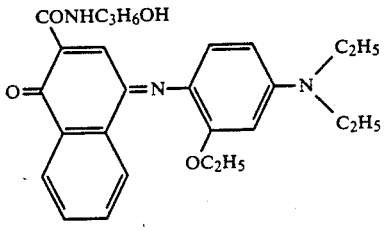

-continued (I)-6

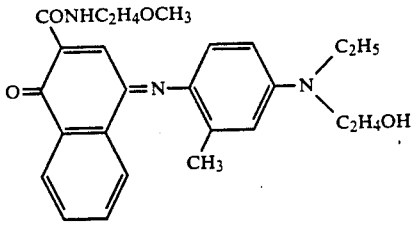

(I)-7

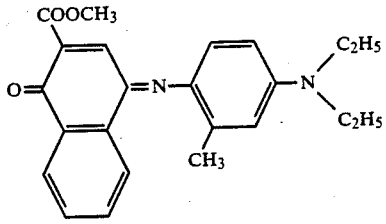

(I)-8

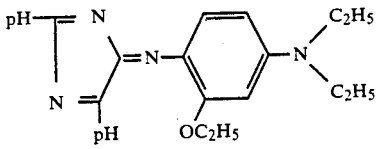

The maximum absorption wavelengths and half-widths of each of components (I)-1, (I)-2, (I)-4 and (I)-7 are 672 nm and 143 nm, 663 nm and 144 nm, 660 nm and 149 nm, and 664 nm and 148 nm, respectively. All of these dyes (I) can be used either individually or as a mixture.

The other cyan dye (II) to be used in a mixture with the above dye (I) has a maximum absorption at 650 nm or shorter, and a main absorption peak in its absorption spectrum is sharp, and when the top of the peak in the absorption spectrum is made 100% of absorbance, one having a wavelength width at 50% of absorbance in the range of 50 to 120 nm is preferable. If the wavelength width becomes wider than the above range, the skirt of the absorption curve on the shorter wavelength becomes greater in the range of 540 nm or shorter, whereby the object of the present invention cannot be undesirably accomplished.

Preferable examples of the above dye (II) may include:

(II)-1

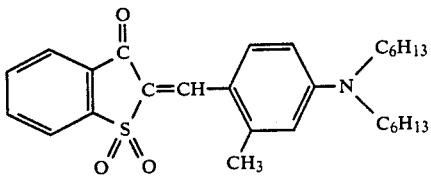

(II)-2

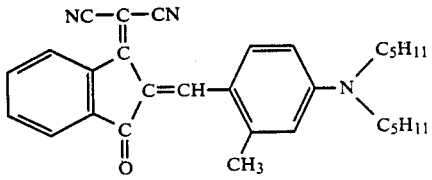

-continued (II)-3

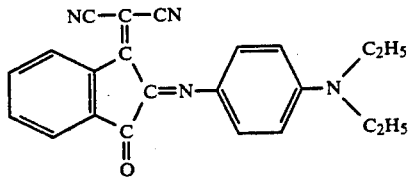

(II)-4

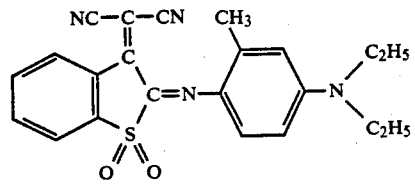

The maximum absorption wavelenghts and half-widths of each of compounds (II)-2 and (II)-3 are 592 nm and 99 nm, and 621 nm and 110 nm, respectively. All of these dyes (II) can be used either individually or as a mixture.

A preferable ratio of the dye (I) and the dye (II) as described above may be a weight ratio of 5:95 to 95:5.

The specific feature of the present invention resides in the point of using the dye (I) and the dye (II) as described above in a mixture which absorbs selectively the wavelength of 600 nm or longer, in shape of a block, whereby a cyan color approximate to ideal with little absorption component of 540 nm or lower and high density can be color formed. In contrast, when the dye (I) alone is used, the color reproducing region is narrow, while when the dye (II) alone is used, the color formed density is low, and also the hue is out of the ideal cyan color, thus failing anyway to exhibit sufficient reproduction of the cyan color and the intermediate color.

As the binder for carrying the heat migratable dye as described above, any of those known in the art are available. Examples of preferable binder resins may include cellulose resins such as ethyl cellulose, hydroxyethyl cellulose, ethylhydroxy cellulose, hydroxypropyl cellulose, methyl cellulose, cellulose acetate, cellulose acetate butyrate, etc., vinyl resins such as polyvinyl alcohol, polyvinyl acetate, polyvinyl butyral, polyvinyl acetal, polyvinyl acetoacetal, polyvinyl pyrrolidone, polyacrylamide, etc., polyesters and others. Among them, cellulose type, acetal type, polyvinyl butyral type and polyester type are particularly preferred.

In one embodiment of the present invention, in forming a dye-receiving layer from the above materials, a fluorescent brightening agent which enhances sharpness of dye by reducing side absorptions can be included.

The fluorescent brightening agent to be used for such purpose is a substantially colorless compound which emits a blue to violet color by absorption of UV-ray in daylight or illuminated light, which has been used in the prior art for brightening of papers, fibers, synthetic fibers. As fluorescent brightening agents, various ones have been known, but preferable brightening agents for the object of the present invention are not water-soluble ones, but those of the disperse dye type.

The fluorescent brightening agent as described above should preferably have heat transferability (heat migratability) similar to the sublimable dye, for example, preferably one having no carboxyl group, sulfonic acid group, etc., and having a molecular weight of 500 or less. If the molecular weight exceeds 500, transferability may be sometimes deficient. Such fluorescent brightening agent is excellent in reducing side absorptions occurring during light absorption of the dye.

Specific examples of the fluorescent brightening agent preferable for the object of the present invention may include:

C. I. Fluorescent Brightening Agent 91
C. I. Fluorescent Brightening Agent 112
C. I. Fluorescent Brightening Agent 121
C. I. Fluorescent Brightening Agent 135
C. I. Fluorescent Brightening Agent 162
C. I. Fluorescent Brightening Agent 170
C. I. Fluorescent Brightening Agent 171
C. I. Fluorescent Brightening Agent 172
Mikawhite STN (Nippon Kayaku K.K., Japan)
Mikawhite GTN (Nippon Kayaku K.K., Japan)
Whitefluor PVG (Sumitomo Kagaku K.K., Japan)
Whitex SNP (Sumitomo Kagaku K.K., Japan)
Kaycoll E (Nippon Soda K.K., Japan)

The above fluorescent brightening agent can be used either individually or as a mixture, and its amount added may be preferably in the range of from 0.01 to 10 parts by weight per 100 parts by weight of the dye. If the amount added is too small, the sharpening effect for the dye is insufficient, while if it is too much, fluorescence disappears due to the so called quenching effect and also the color forming characteristic, sharpness, etc. of the dye will be contrarily impaired undesirably.

As the dye which can enhance the sharpness after transfer by using a fluorescent brightening agent in combination, all of the dyes of magenta color or cyan color used in heat transfer sheets known in the art can be effectively used, and not particularly limited.

The dyes of magenta color or cyan color particularly useful in the present invention are those which, although being lower in sharpness, have other excellent properties such as heat transferability, light resistance, bleeding resistance, etc., and may include the dyes of the following structures.

(III)-1

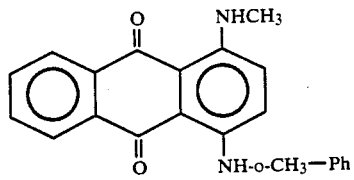

(III)-2

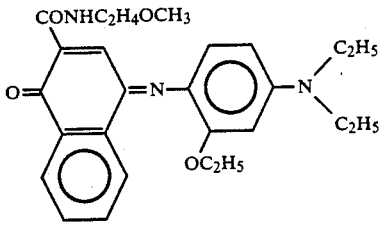

(I)-1

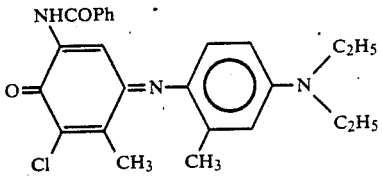

-continued (III)-3

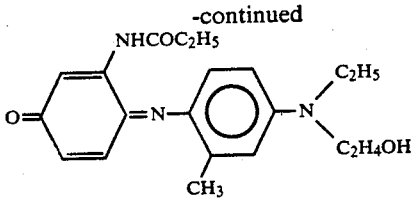

(III)-4

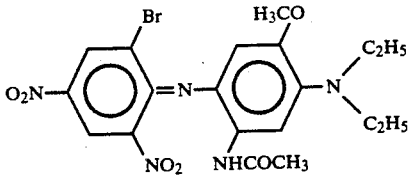

(III)-5

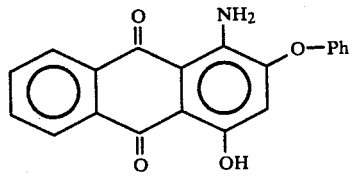

(III)-6

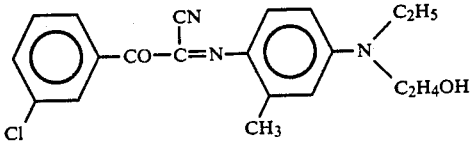

(III)-7

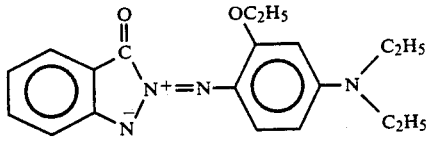

(III)-8

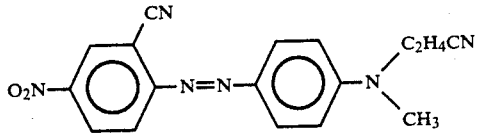

(III)-9

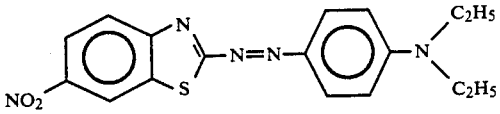

By using an appropriate brightening agent in combination with these dyes, their sharpness after transfer is enhanced.

The dye layer of the heat transfer sheet of the present invention is formed basically of the materials as described above, but, if necessary, can also include various additives similar to those known in the art.

Such dye layer may be preferably formed by adding the sublimable dye, the fluorescent dye, the binder and other optical components as described above in an appropriate solvent to dissolve or disperse the respective components, thereby forming a coating material or an ink for formation of a dye layer, and coating and drying this on the above-described substrate film.

The dye layer thus formed has a thickness of about 0.2 to 5.0 μm, preferably 0.4 to 2.0 μm, while the sublimable dye in the dye layer should suitably exist in an amount of 5 to 90% by weight, preferably 10 to 70% by weight, based on the weight of the dye layer.

In another embodiment of the present invention, the specific feature resides in forming a dye layer without inclusion of a fluorescent brightening agent in the dye layer in the embodiment as described above, and forming a fluorescent brightening agent as the thin film on the surface of the dye layer.

The thin film of a fluorescent brightening agent may be formed by dissolving a fluorescent brightening agent as described above in a solvent and coating and drying the solution on the surface of the dye layer, or preferably by dissolving a fluorescent brightening agent together with the above-mentioned binder in a solvent and coating and drying the solution on the surface of the dye layer, thereby forming the fluorescent brightening agent layer. The ratio of the fluorescent brightening agent and the binder used is not particularly limited, but generally about a fluorescent brightening agent/binder ratio = 1/10 to 10/1 in terms of weight ratio. The thickness of the layer to be formed may be generally about 0.05 to 10 μm. If it is too thin, the sharpening effect of the transfer dye is insufficient, while if it is too thick, transferability of the dye is undesirably obstructed.

The heat transfer sheet of the present invention as described above can also have a heat-resistant layer provided thereon for prevention of deleterious influences by the heat of a thermal head.

Having described above about the basic constitution of the heat transfer sheet of the present invention, the heat transfer sheet of the present invention may be a mono-color sheet having only the above-mentioned cyan dye layer. In this case, in forming a full-color image, heat transfer sheets of other colors of yellow, magenta (and black) are used. Also, in a preferred embodiment of the present invention, the transfer sheet can be made by providing on a continuous substrate sheet, the respective dyes of yellow, magenta (and black) together with the cyan dye layer as described above plane successively, for example, alternately at every 30 cm width.

The image-receiving sheet to be used for formation of images by use of the heat transfer sheet as described above may be any one, provided that its recording surface has dye receptivity for the above-mentioned dye, and also in the case of a paper, metal, glass, synthetic resin or sheet, etc. having no dye receptivity, a dye receptive layer may be formed from a resin excellent in dye receptivity on at least one surface thereof. Also, such dye receptive layer should preferably incorporate as the release agent a solid wax such as polyethylene wax, amide wax, Teflon powder, etc., a fluorine type, phosphoric acid ester type surfactant, a silicone oil, etc. known in the art.

For the means for imparting heat energy during heat transfer to be used in the present invention, any of the imparting means known in the art can be used. For example, by means of a recording device such as a thermal printer (e.g., Video Printer VY-100, Hitachi Seisakusho K.K., Japan), etc. the desired objects can be fully accomplished by controlling the recording time to impart a heat energy of about 5 to 100 mJ/mm$^2$.

According to the present invention as described above, by forming the dye layer of cyan color of the heat transfer sheet from two or more kinds of cyan dyes, and making the dye having a maximum absorption on the shortest wavelength side of the cyan dyes a dye with narrow absorption width, it becomes possible to form a cyan color with little absorption components at 540 nm or lower even at high density, whereby a heat transfer sheet capable of forming recorded images excellent in color reproducibility of the cyan color of the original as a matter of course, and also the intermediate color synthesized with said cyan color and other colors can be provided. The present invention is described in more detail by referring to Examples and Comparative Examples. In the sentences, parts or % are based on weight unless otherwise particularly noted.

EXAMPLE A

An ink composition for formation of dye layer having the composition shown below was prepared, and coated and dried on a polyethylene terephthalate film applied on the back with heat-resistant treatment with a thickness of 6 μm to a dried coated amount of 1.0 g/m² to obtain a heat transfer sheet of the present invention shown below in Table 1.

TABLE 1.

| | |
|---|---|
| The above dye (I) and The above dye (II) | 3.0 parts as the total |
| Polyvinyl butyral resin (Ethlec BX-1, Sekisui Kagaku, Japan) | 4.5 parts |
| Methyl ethyl ketone | 46.25 parts |
| Toluene | 46.25 parts |

However, in the above composition, when the dye mixture is insoluble, DMF, dioxane, chloroform, etc. were suitably used.

Also, in the above composition, a yellow dye (Foronn Brilliant Yellow S-6GL, Sandoz) was used to prepare a yellow heat transfer sheet.

Next, by use of a synthetic paper (Yupo FPG #150, Oji-Yuka) as the substrate sheet, a coating solution having the composition shown below was coated on one surface thereof at a ratio of 10.0 g/m² on drying, followed by drying at 100° C. for 30 minutes, to obtain a heat transfer image-receiving sheet.

| | |
|---|---|
| Polyester resin (Vylon 200, Toyobo, Japan) | 11.5 parts |
| Vinyl chloride-vinyl acetate copolymer (VYHH, UCC) | 5.0 parts |
| Amino-modified silicone (KF-393, Shinetsu Kagaku Kogyo, Japan) | 1.2 parts |
| Epoxy-modified silicone (X-22-243, Shinetsu Kagaku Kogyo, Japan) | 1.2 parts |
| Methyl ethyl ketone/Toluene/Cyclohexanone (weight ratio 4:4:2) | 102.0 parts |

The above yellow heat transfer sheet and the above image-receiving sheet were superposed with the dye layer and the dye-receiving surface of the respective sheets being opposed to each other, and solid printing was performed with a thermal head from the back surface of the heat transfer sheet under the conditions of a head application voltage of 11 V and a printing time of 14 msec., followed subsequently by printing on the same image-receiving sheet with the same pattern as overlapped on the yellow image by use of the above-mentioned cyan heat transfer sheet, along with solid printing of the cyan mono-color under the conditions of head application voltage 11 V and a printing time of 16 msec, to obtain the results shown below in Table 1.

TABLE 1

| Kind of dye I | Kind of dye II | Mixing ratio I/II | Color density Cyan | Color reproducibility Green | Color reproducibility Cyan |
|---|---|---|---|---|---|
| 1 | 1 | 70/30 | 2.10 | ◎ | ◎ |
| 1 | 2 | 70/30 | 2.05 | ◎ | ◎ |

TABLE 1-continued

| Kind of dye I | Kind of dye II | Mixing ratio I/II | Color density Cyan | Color reproducibility Green | Color reproducibility Cyan |
|---|---|---|---|---|---|
| 1 | 3 | 40/60 | 2.00 | ◎ | ◎ |
| 1 | 4 | 50/50 | 1.97 | ◎ | ◎ |
| 2 | 1 | 50/50 | 1.85 | ◎ | ◎ |
| 2 | 2 | 50/50 | 1.85 | ◎ | ◎ |
| 3 | 1 | 80/20 | 1.92 | ◎ | ◎ |
| 3 | 2 | 80/20 | 1.80 | ◎ | ◎ |
| 3 | 3 | 60/40 | 2.05 | ◎ | ◎ |
| 3 | 4 | 50/50 | 2.10 | ◎ | ◎ |
| 4 | 1 | 60/40 | 1.90 | ◎ | ◎ |
| 4 | 2 | 30/70 | 2.00 | ◎ | ◎ |
| 5 | 3 | 80/20 | 1.95 | ◎ | ◎ |
| 5 | 4 | 50/50 | 1.83 | ◎ | ◎ |
| 6 | 1 | 50/50 | 1.90 | ◎ | ◎ |
| 6 | 2 | 50/50 | 1.85 | ◎ | ◎ |
| 7 | 2 | 40/60 | 1.83 | ◎ | ◎ |
| 7 | 3 | 50/50 | 1.95 | ◎ | ◎ |
| 8 | 3 | 70/30 | 2.05 | ◎ | ◎ |
| 8 | 4 | 50/50 | 1.95 | ◎ | ◎ |

The mixing ratio in the above Table is based on weight. Also, the hues of the mixed dyes are all cyan colors.

COMPARATIVE EXAMPLE A

Example 1 was repeated except for using the dyes shown below in Table 2 in place of the dyes in Example A to obtain the results shown below in Table 2.

TABLE 2

| Kind of dye I | Kind of dye II | Mixing ratio I/II | Color density Cyan | Color reproducibility Green | Color reproducibility Cyan |
|---|---|---|---|---|---|
| *1 | — | — | 1.70 | Δ | Δ |
| *2 | — | — | 1.75 | Δ | ○ |
| — | *3 | — | 1.60 | Δ | Δ |
| — | *4 | — | 1.55 | Δ | Δ |
| *1 | *5 | 50/50 | 1.65 | X | Δ |
| *2 | *6 | 50/50 | 1.95 | X | X |

*1: Dye (I)-1
*2: Dye (I)-2
*3: Dye (II)-1
*4: Dye (II)-4

*5:

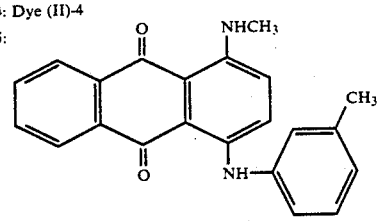

*6:

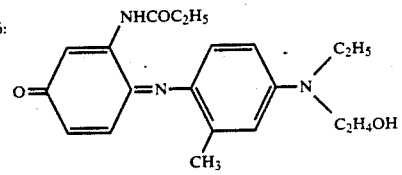

The color forming density as mentioned above is a value measured by a densitometer RD-918 manufactured by Macbeth Co., U.S.A.

Color reproducibility was evaluated by observation with eyes.

◎: very sharp
○: sharp
Δ: slightly indistinct
x: indistinct

EXAMPLE B1

An ink composition for formation of dye layer having the composition shown below was prepared and coated by a wire bar and dried on a polyethylene terephthalate film with a thickness of 4.5 μm applied on the back with heat-resistant treatment (Lumilar 5AF53, Toray, Japan) to a dry coated amount of 1.0 g/m² to obtain a heat transfer sheet (1) of the present invention.

| | |
|---|---|
| Sublimable dye (the above exemplary dye (III)-1) | 5.5 parts |
| Polyvinyl acetoacetal (Sekisui Kagaku, Japan) | 4.0 parts |
| C.I. Fluorescent Brightening Agent 162 | 0.05 parts |
| Methyl ethyl ketone/toluene (weight ratio 1/1) | 89.0 parts |

EXAMPLE B1 to B6

Example B1 was repeated except for using the dyes and the fluorescent brightening agents in place of the dye and the fluorescent brightening agent in Example B1 to obtain the heat transfer sheets (2) to (6) of the present invention.

EXAMPLE B2

Dye: the above exemplary dye (III-2)
Fluorescent brightening agent:
C.I. Fluorescent Brightening Agent 162

EXAMPLE B3

Dye: the above exemplary dye (I-1)
Fluorescent brightening agent:
C.I. Fluorescent Brightening Agent 162

EXAMPLE B4

Dye: the above exemplary dye (III-5)
Fluorescent brightening agent:
C.I. Fluorescent Brightening Agent 91

EXAMPLE B5

Dye: the above exemplary dye (III-6)
Fluorescent brightening agent:
C.I. Fluorescent Brightening Agent 164

EXAMPLE B6

Dye: the above exemplary dye (III-7)
Fluorescent brightening agent:
C.I. Fluorescent Brightening Agent 172

EXAMPLE B7

An ink composition A for formation of dye layer having the composition shown below was prepared, and coated by a wire bar and dried on a polyethylene terephthalate film with a thickness of 4.5 μm applied on the back with heat-resistant treatment (Lumilar 5AF53, Toray, Japan) to a dry coated amount of 1.0 g/m², and further on its surface was coated and dried a composition B shown below to a dry coated amount of 1.0 g/m² to obtain a heat transfer sheet (7) of the present invention.

| | |
|---|---|
| Composition A | |
| Sublimable dye (the above exemplary dye (I-1)) | 5.5 parts |
| Polyvinyl butyral resin (Ethec BX-1, Sekisui Kagaku) | 4.5 parts |
| Methyl ethyl ketone/toluene (weight ratio 1/1) | 90.0 parts |
| Composition B | |
| Polyvinyl butyral resin (Ethlec BX-1, Sekisui Kagaku) | 6.0 parts |
| C.I. Fluorescent Brightening Agent 162 | 0.3 parts |
| Methyl ethyl ketone/toluene (weight ratio 1/1) | 90.0 parts |

COMPARATIVE EXAMPLES B1 to B3

Examples B1 to B3 were repeated except for no fluorescent brightening agent in Examples B1 to B3 was used to obtain heat transfer sheets of (a) to (c) of Comparative Examples.

REFERENCE EXAMPLE 1

By use of a synthetic paper (Yupo FPG #150, thickness 150 μm, Oji-Yuka) as the substrate sheet, a coating solution having the composition shown below was coated by a bar coater and dried on one surface thereof at a ratio of 5.0 g/m² on drying, to obtain a heat transfer sheet (A).

| | |
|---|---|
| Polyester resin (Vylon 200, Toyobo) | 4.0 parts |
| Vinyl chloride-vinyl acetate copolymer (#1000A, Denki Kagaku) | 6.0 parts |
| Amino-modified silicone (X-22-3050C, Shinetsu Kagaku Kogyo) | 0.2 part |
| Epoxy-modified silicone (X-22-300E, Shinetsu Kagaku Kogyo) | 0.2 part |
| Methyl ethyl ketone/Toluene (weight ratio 1:1) | 89.6 parts |

REFERENCE EXAMPLE 2

By use of a synthetic paper (Yupo FPG #150, thickness 150 μm, Oji-Yuka) as the substrate sheet, a coating solution having the composition shown below was coated by a bar coater and dried on one surface thereof at a ratio of 5.0 g/m² on drying, to obtain a heat transfer sheet (B).

| | |
|---|---|
| Polyester resin (Vylon 200, Toyobo) | 4.0 parts |
| Vinyl chloride-vinyl acetate copolymer (#1000A, Denki Kagaku) | 6.0 parts |
| Amino-modified silicone (X-22-3050C, Shinetsu Kagaku Kogyo) | 0.2 part |
| Epoxy-modified silicone (X-22-300E, Shinetsu Kagaku Kogyo) | 0.2 part |
| Fluorescent brightening agent (Ubitex OB, Ciba-Geigy) | 0.005 part |
| Methyl ethyl ketone/Toluene (weight ratio 1:1) | 87.6 parts |

REFERENCE EXAMPLE 3

A heat transfer sheet (Z) of Reference Example was obtained in the same manner as in Example B1 except for using a yellow dye (Foron Brilliant Yellow S-6GL, Sandoz) in place of the dye in Example B1.

USE EXAMPLE

Each of the heat transfer sheets of Examples B1 to B7 and Comparative Examples B1 to B3, and each of the heat transfer image-receiving sheets were superposed with the dye layer and the dye-receiving surface of the respective sheets being opposed to each other, and recording was performed by means of a heat-sensitive sublimation transfer printer (VY-50, Hitachi Seisakusho K.K.) with a thermal head from the back surface of the heat transfer sheet at a printing energy of 90 mJ/mm$^2$. Similarly, on each of the heat transfer receiving sheets of Reference Examples 1 to 2 recorded by use of the heat transfer sheet (Z), recording was performed by overlapping recording by use of each of the heat transfer sheets of Examples 1 to 7 and Comparative Examples B1 to B3, to obtain the results shown below in Table 3.

TABLE 3

| Heat transfer sheet | Image-receiving sheet | Sharpness | Color reproducibility |
|---|---|---|---|
| 1 | A | ◎ | ◎ |
| 2 | A | ◎ | ◎ |
| 3 | A | ◎ | ◎ |
| 4 | A | ◎ | ◎ |
| 5 | A | ◎ | ◎ |
| 6 | A | ◎ | ◎ |
| 7 | A | ◎ | ◎ |
| a | A | X | X |
| b | A | Δ | Δ |
| c | A | Δ | Δ |
| a | B | ○ | ○ |
| b | B | ○ | ○ |
| c | B | ○ | ○ |

Evaluation standards (1) Sharpness: sharpness of magenta and cyan monocolors was evaluated by observation with eyes.

◎: very sharp

○: sharp

Δ: slightly indistinct x: indistinct (2) Color reproducibility: sharpness of the secondary color obtained by overlapping recording of the heat transfer sheet (Z) and each of the heat transfer sheets 1 to 7 and a to c was evaluated by observation with eyes, and color reproducibility was judged from the sharpness.

◎: very good

○: good

Δ: slightly good

X: bad

As can be apparently seen from the above Examples, in the present invention, by including a fluorescent brightening agent in the dye layer of magenta color or cyan color of the heat transfer sheet or forming a layer containing the above fluorescent brightening agent on the surface of the dye layer, and transferring these fluorescent brightening agents to the image forming region simultaneously with transfer of the dye, it becomes unnecessary to use a fluorescent brightening agent in the dye receiving layer, whereby a color image excellent in sharpness and color reproducibility can be obtained without lowering the color forming characteristic or sharpness of yellow color.

We claim:

1. A heat transfer sheet comprising:

a substrate sheet; and at least a dye layer of cyan color formed on at least one surface of said substrate sheet, said dye layer comprising a binder and a mixture of at least two kinds of sublimable cyan dyes, one dye having a maximum absorption on the longer wavelength side of 660 nm or longer, and another dye having a maximum absorption at 650 nm or shorter when color formation is effected on an image-receiving sheet.

2. The heat transfer sheet of claim 1, wherein the dye having the maximum absorption at 650 nm or shorter has a wavelength width of 50 to 120 nm at the 50% absorption of a maximum absorption when color formation is effected on an image-receiving sheet.

3. The heat transfer sheet of claim 1, further comprising a dye layer of magenta color comprising a sublimable magenta dye and a binder.

4. The heat transfer sheet of claim 3, wherein said dye layer further comprises a sublimable fluorescent brightening agent in and/or on a surface thereof.

5. The heat transfer sheet of claim 4 ,wherein said fluorescent brightening agent comprises a substance having a molecular weight of 500 or less.

6. A heat transfer sheet comprising:

a substrate sheet; and a dye layer of magenta and/or cyan color formed on at least one surface of said substrate sheet, said dye layer comprising a sublimable dye, a binder, and a sublimable fluorescent brightening agent in and/or on a surface thereof.

7. The heat transfer sheet of claim 6, wherein said fluorescent brightening agent has a molecular weight of 500 or less.

* * * * *